United States Patent [19]

Shockey et al.

[11] Patent Number: 4,884,514

[45] Date of Patent: Dec. 5, 1989

[54] AUTOMATIC TELLER MACHINE HOUSING

[75] Inventors: Brent J. Shockey; Rodney R. Tompkins, both of Wayne, Nebr.

[73] Assignee: Heritage Industries, Inc., Wayne, Nebr.

[21] Appl. No.: 224,849

[22] Filed: Jul. 27, 1988

[51] Int. Cl.[4] ..... G07G 5/00

[52] U.S. Cl. ..... 109/24.1; 109/2; 109/66

[58] Field of Search ..... 109/24.1, 2, 16, 64, 109/71, 66, 73; 221/281

[56] References Cited

U.S. PATENT DOCUMENTS

| | | | |
|---|---|---|---|
| 4,399,755 | 8/1983 | Wiedmann | 109/2 |
| 4,417,527 | 11/1983 | Williams | 109/2 |
| 4,497,261 | 2/1985 | Ferris | 109/2 |
| 4,558,650 | 12/1985 | Berman | 109/24.1 |
| 4,696,239 | 9/1987 | Trucksess | 109/24.1 |

*Primary Examiner*—Robert L. Wolfe

*Attorney, Agent, or Firm*—Zarley, McKee, Thomte, Voorhees & Sease

[57] ABSTRACT

An automatic teller machine housing includes a conventional automatic teller machine having a money cassette portion, a display panel and internal mechanical and electrical components. The ATM is mounted in the housing with the display panel exposed along one longitudinal side of the housing, the housing being a width slightly greater than the depth of the money cassette, and large enough to allow rotational movement of the money cassette. The money cassette is rotatably and slidably mounted within a vault within the housing so as to be moveable between an operable position in engagement with the display panel and transversely oriented to the longitudinal walls of the housing, and a loading position generally parallel with the longitudinal walls of the housing. A turntable having a slidable platform mounted thereon is utilized to support the money cassette within a vault, so as to permit the appropriate movement of the money cassette from the operable position to the loading position.

4 Claims, 5 Drawing Sheets

AUTOMATIC TELLER MACHINE HOUSING

TECHNICAL FIELD OF THE INVENTION

The present invention relates generally to automatic teller machine structures, and more particularly to ATM structures which are located on a drive-through bank service island.

BACKGROUND OF THE INVENTION

Automatic teller machines have become common at banking institutions across the country. These machines are designed to assist bank customers in obtaining and depositing cash and are electronically connected to the customers' banking facility.

With the advent of these ATM's, many bank facilities have added an ATM to an exterior drive-through service island which has been widened in order to hold the housing for the ATM. To date, such ATM housings require an extra wide island such that the rearward side of the ATM has working space maintained within the housing to allow for maintenance and refilling of the conventional money cassette. As the pneumatic tube type systems (which are presently utilized on drive-through service islands) are discontinued—due to the increasing success and preference for ATM's—it has become desirable to attempt to locate an ATM and housing on the narrow drive-through service island.

Some degree of success has been achieved by prior art ATM housings which allow the housing to expand so as to move the ATM from a directly lateral facing position to an orientation which allows access to the rear of the ATM. However, such housings will project into the drive-through lane when access is desired to the ATM and money cassette. Such a projection into the drive-through lane is obviously quite hazardous for the machine service personnel as well as the customer.

The exposed location of the ATM makes any routine service risky and inconvenient without a secure housing in which the serviceman can access the machine. Such a housing is necessary not only to provide security but also to provide shelter for the electrical machinery of the device.

Therefore, it is a principal object of the present invention to provide an ATM housing which will fit on a drive-through bank service island without expanding into the drive-through lanes.

Another object of the present invention is to provide an ATM housing with an ATM having components which are accessible within the housing.

A further object is to provide a housing having a rotatable component to provide access to the rearward end of the money cassette of the ATM within a narrow housing.

Yet another object of the present invention is to provide a housing for an ATM which is economical of manufacture, durable in use and refined in appearance.

A specific object of the invention is to provide an automated teller machine facility, for example, which is ideally suited for use on a drive-up banking facility service island where frugal use of space is important.

These and other objects will be apparent to those skilled in the art.

SUMMARY OF THE INVENTION

The automatic teller machine housing of this invention includes a conventional automatic teller machine (ATM) having a money cassette portion, a display panel and internal mechanical and electrical components. The ATM is mounted in the housing with the display panel exposed along one longitudinal side of the housing, the housing being a width slightly greater than the depth of the money cassette, and large enough to allow rotatable movement of the money cassette. The money cassette is rotatably and slidably mounted within a vault within the housing so as to be moveable between an operable position in engagement with the panel and transverse to the longitudinal walls of the housing, and a loading position generally parallel with the longitudinal walls of the housing. The movable mounting of the money cassette allows the housing to be a narrow enough width to fit upon a bank drive-through service island, and allow access therein to load the money. A turntable having a slidable platform mounted thereon is utilized to support the money cassette within a vault, so as to permit the appropriate movement of the money cassette from the operable position to the loading position.

DESCRIPTION OF THE PREFERRED EMBODIMENT

Figure 1:
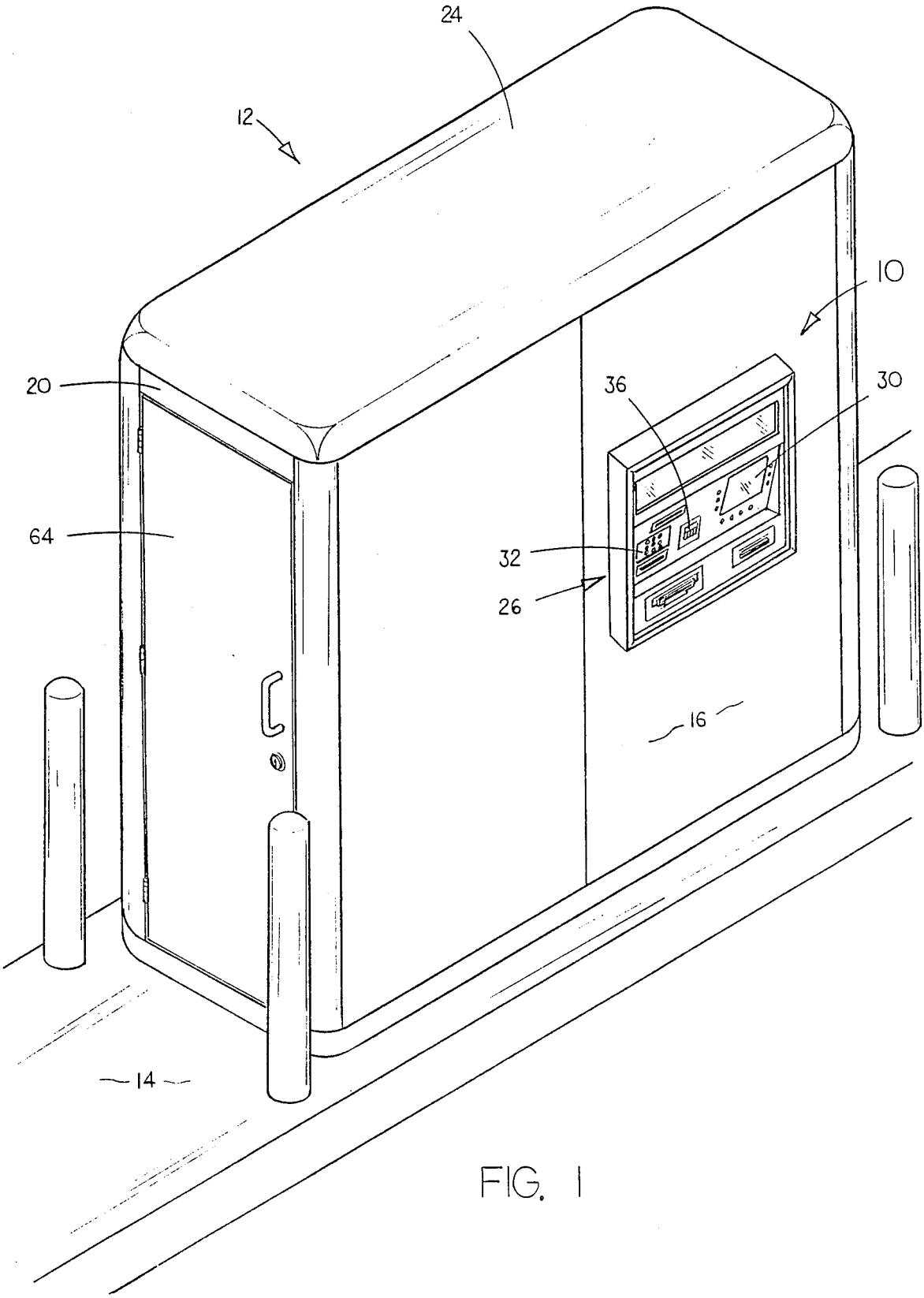
FIG. 1 is a perspective view of the housing of this invention located on a drive-through bank service island.

Referring now to the drawings in which identical or corresponding parts are identified with the same reference numeral, and more particularly to FIG. 1, an automated teller machine (ATM) is designated generally at 10 and is mounted within a housing 12. Housing 12 is located on a conventional drive-through service island 14, and includes a front longitudinal side 16, a rearward longitudinal side 18 (not seen in FIG. 1), a pair of opposing ends 20 and 22 (ends 22 not being seen in FIG. 1) and a top 24. The main feature of the housing 12 which distinguishes it from those of prior art ATM housings is in the fact that the housing is not expandable so as to intrude on the driving lane on either the forward or rearward side of the housing.

Figure 4:
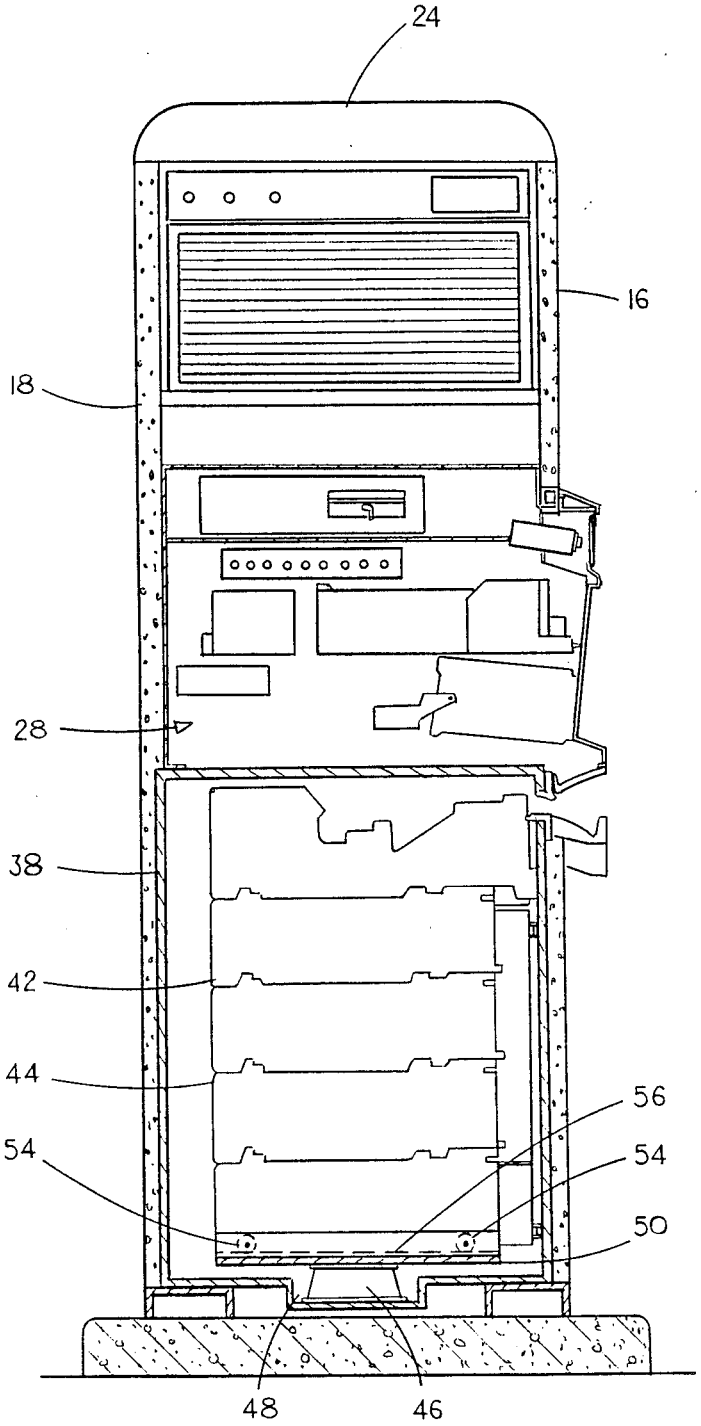
FIG. 4 is a sectional view of the housing taken at lines 4—4 in FIG. 2.
Figure 5:
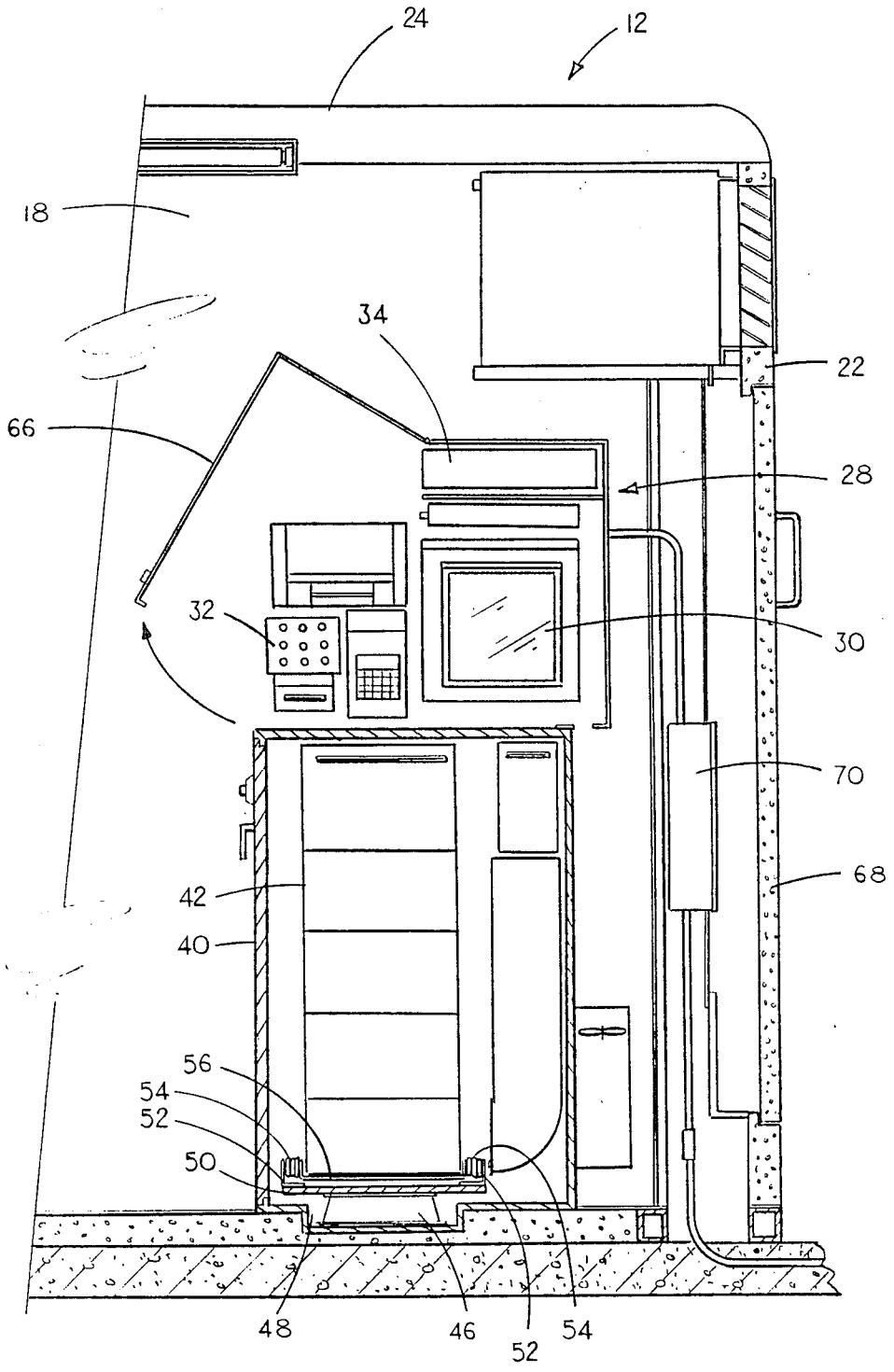
FIG. 5 is a partial sectional view taken at lines 5—5 in FIG. 2.

Referring now to FIGS. 1, 4 and 5, ATM 10 includes a display panel 26 mounted on front side 16 of housing 12. Display panel 26 gives visual and electronic access to several components of the ATM which are housed within upper cabinet 28 within housing 12. Upper cabinet 28 holds, inter alia, the video display screen 30, keypad 32, central processing unit 34 and an identification card processing unit 36. Other necessary components are housed within cabinet 28 and are conventional in the art. All of the components of ATM 10 are arranged within upper cabinet 28, which is preferably built as an integral part of housing 12.

Upper cabinet 28 is mounted on top of a vault 38, vault 38 having a hinged and lockable door 40 on one side thereof. Vault 38 is of heavy steel construction and is permanently mounted within housing 12. Vault 38 will hold the money cassette component 42 of the ATM.

Money cassette 42 is the main component of the ATM which requires frequent service—namely, refilling with cash for dispensing to customers. Because the money cassette must be accessed through its rearward end 44, prior art ATM housings required sufficient space rearward of the money cassette and the ATM 10 to allow a person to reload the money cassette 42. This additional space is not present on a drive-through service island.

Money cassette 42 has a conventional width, depth and height, and vault 38 is constructed with relation to the dimensions of the money cassette. A roller bearing turntable 46 is mounted in a depression 48 in the base of vault 38, as seen in FIGS. 4 and 5. A platform 50 is mounted to roller bearing turntable 46 so as to be freely rotatable thereon. A pair of rails 52 are affixed to the two opposing longitudinal edges of platform 50 and serve as guides for roller wheels 54 which are attached to slidable shelf 56. Money cassette 42 is mounted on shelf 56 for slidable movement therewith.

Figure 2:
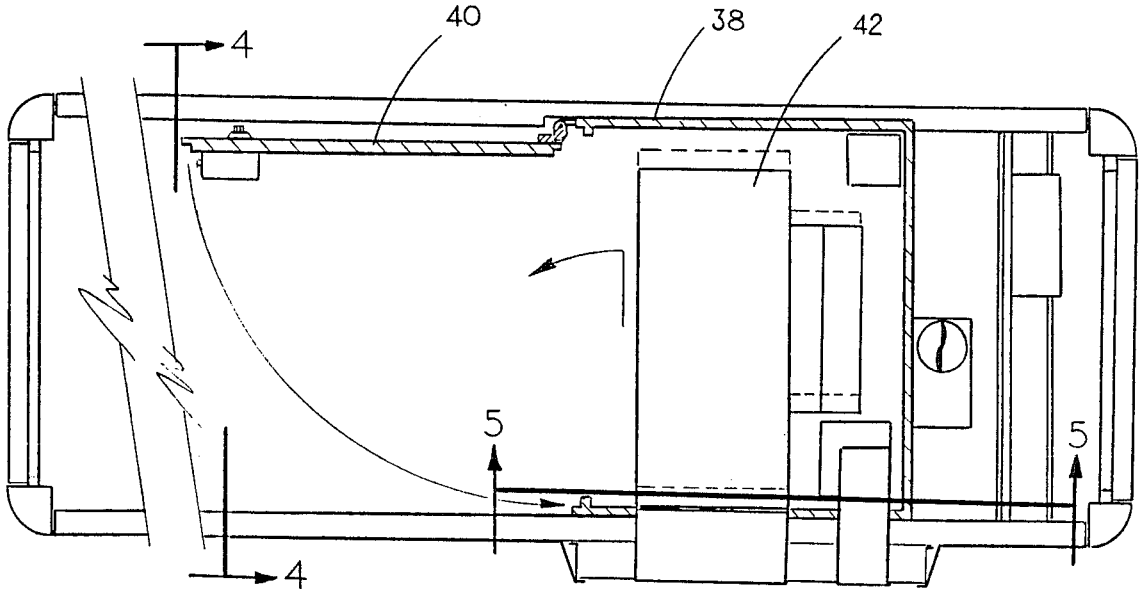
FIG. 2 is a plan view of the housing of FIG. 1 and a top sectional view through the vault housing the ATM and money cassette.
Figure 3:
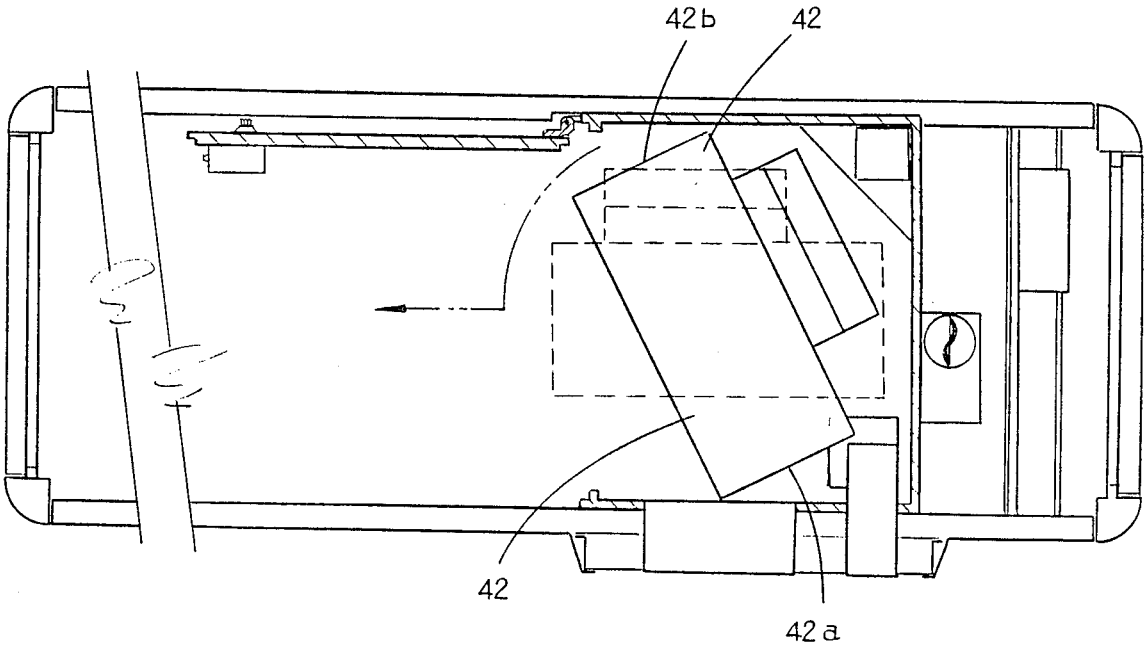
FIG. 3 is a plan view of the housing with the money cassette shown in a rotated position.
Figure 6:
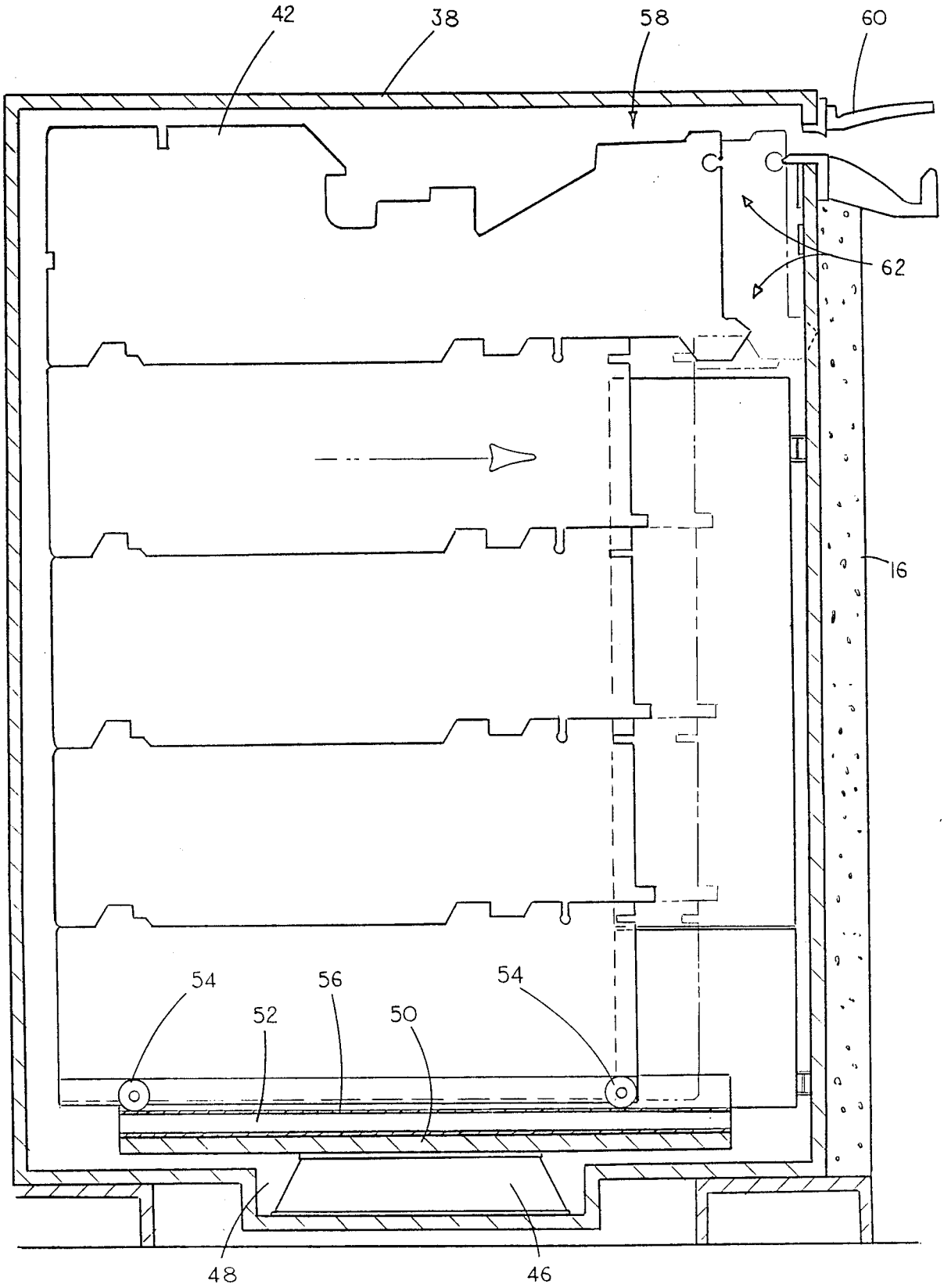
FIG. 6 is an enlarged view of a portion of FIG. 4.

The upper end of money cassette 42 has a forward money-dispensing portion 58 which is journaled in operable alignment with a dispensing chute 60 mounted in the forward-facing wall of vault 38. An alignment and locking mechanism 62 guides the money-dispensing portion 58 into operable relationship with the money-dispensing chute, as shown in FIG. 6. The depth of vault 38 is slightly greater than the depth of money cassette 42, such that money cassette 42 may be rolled backwards (along with sliding platform 56) out of engagement with money dispensing chute 60, as shown in FIG. 6, and in broken lines in FIG. 2. Money cassette 42 may then be rotated on turntable 46, as shown in FIG. 3, into the broken-line position shown in FIG. 3. This allows access into the rearward end **42*b*** of the money cassettes for filling or servicing the money cassette.

It can therefore be seen that the housing 12 of the present invention provides a secure work area within the housing 12 through a lockable door 64 in end 20. Housing 12 is narrow enough to fit on a drive-through service island 14, and has a width slightly greater than the money cassette 42, to allow rotational movement thereof. Because there is no need to move upper cabinet 28 or its internal components in order to access money cassette 42, housing 12 need not have any pivotable or otherwise expandable panels which would project into the drive-through lanes adjacent island 14. Because housing 12 is rigid and has only a door at each end, the security and weather-insulating characteristics of the building are much greater than those of the prior art. This not only assists in maintaining a more stable environment within housing 12, but also eliminates at least one area of potential breakdown and maintenance.

Once the service personnel are within housing 12, door 64 may be locked to secure the area. If service is necessary on the components within upper cabinet 28, a hinged panel 66 (see FIG. 5) may be raised so as to access these components. If maintenance or reloading of the money cassette is required, the service personnel must first unlock the vault door 40 to access cassette 42. Money cassette 42 is then slided slightly rearwardly to disengage it from the money dispensing chute 60 (see FIG. 6), and then rotated on turntable 46 as shown in FIG. 3. If necessary, money cassette 42 may be rolled completely out of the vault and removed from housing 12, without affecting the components in upper cabinet 28. It can be seen that the turntable and slidable shelf arrangement upon which the money cassette is mounted allows for an extremely narrow housing 12 which does not require the interior space to be expanded in order to allow access and maintenance of the various components. As shown in FIG. 5, a temperature control unit 66 is mounted within housing 12 to maintain the appropriate temperature within the housing. An access panel 68 in end 22 allows service personnel to access electrical control box 70.

Whereas the invention has been shown and described in connection with the preferred embodiment thereof it will be understood that many modifications, substitutions and additions may be made which are within the intended broad scope of the appended claims.

Thus it can be seen that the invention accomplishes at least all of the above stated objectives.

We claim:

1. In combination:

a housing having a pair of opposite longitudinal sides, opposite ends, top, and bottom, said housing being secured to the ground;

an automatic teller machine (ATM) operably mounted in said housing, comprising:

a display panel permanently mounted in a longitudinal side of said housing, and having operable keys thereon;

said display panel further comprising a money-dispensing chute secured therein for dispensing money from the interior of said housing to the exterior of said housing;

internal mechanical and electrical processing components mounted within said housing and electrically connected to said display panel to process transactions entered by said keys; and a money cassette for dispensing money to said money dispensing chute, operably mounted in said housing for movement independent of said display panel and internal mechanical and electrical processing components;

said housing having a width slightly greater than the depth of the money cassette, but great enough to allow rotational movement of the money cassette;

service entry means for gaining entrance to said housing;

mounting means within said housing for movably mounting said money cassette, said money cassette being movable between an operable position generally perpendicular to the longitudinal sides of said housing and in engagement with said money dispensing chute, and a loading position oriented generally parallel to said housing longitudinal sides and disengaged from said money dispensing chute.

2. The combination of claim 1 wherein said mounting means includes a roller bearing turntable supporting said money cassette, said housing bottom having a depression formed therein adapted to receive said turntable, and said turntable being operably positioned within said depression.

3. The combination of claim 2, wherein said mounting means further includes a platform mounted on said turntable for operable rotation therewith, said money cassette being slidably mounted on said platform for slidable movement independent of rotatable movement of the platform, such that said money cassette may be moved from said operable position to said loading position by sliding and rotating the money cassette on said platform.

4. The combination of claim 1, said housing further comprising:

a vault means therein enclosing said money cassette and separating it from said internal mechanical and electrical processing components;

said money cassette and said mounting means being operably mounted within said vault means;

said vault means having a selectively lockable door accessing said money cassette; and said vault means having an opening in engagement with said money dispensing chute, to permit selective engagement of said money cassette with said money dispensing chute.

* * * * *